United States Patent [19]

Main et al.

[11] 4,040,280

[45] Aug. 9, 1977

[54] ANTI-MANIPULATION DEVICE FOR PERMUTATION LOCKS

[76] Inventors: James Main, 10, Queen Elizabeth Crescent, Accrington, Lancashire; Leslie Robert Moss, 30, Baird Gardens, Dulwich Wood Park, London, S.E. 19; Ralph Perryman, 138, Stafford Road, Caterham, Surrey, all of England

[21] Appl. No.: 641,246

[22] Filed: Dec. 16, 1975

[30] Foreign Application Priority Data

Dec. 17, 1974 United Kingdom ..... 54519/74

[51] Int. Cl.[2] ..... E05B 15/14

[52] U.S. Cl. ..... 70/333 R; 70/323

[58] Field of Search ..... 70/301–312, 70/323, 333 R, 286, 291

[56] References Cited

U.S. PATENT DOCUMENTS

| | | | |
|---|---|---|---|
| 1,847,071 | 3/1932 | Doenges | 70/323 X |
| 1,925,980 | 9/1933 | Doenges | 70/323 |
| 1,928,853 | 10/1933 | Doenges | 70/323 |
| 2,016,487 | 10/1935 | Doenges | 70/323 |
| 2,856,765 | 10/1958 | Sreb | 70/333 R |

*Primary Examiner*—Roy D. Frazier
*Assistant Examiner*—William E. Lyddane
*Attorney, Agent, or Firm*—Cameron, Kerkam, Sutton, Stowell & Stowell

[57] ABSTRACT

This invention is concerned with permutation locks having a wheel pack comprising a plurality of rotatable permutation discs, each having a recess which must be correctly aligned before the bolt of the lock can be withdrawn. One known method for determining the positions of the permutation discs is by analysis of X-radiation which has passed through the wheel pack parallel to the axis of rotation of the discs. In locks according to this invention, the opacity of the wheel pack to penetrating electromagnetic radiation along any line parallel to the axis of rotation of the discs is independent of their orientation.

4 Claims, 1 Drawing Figure

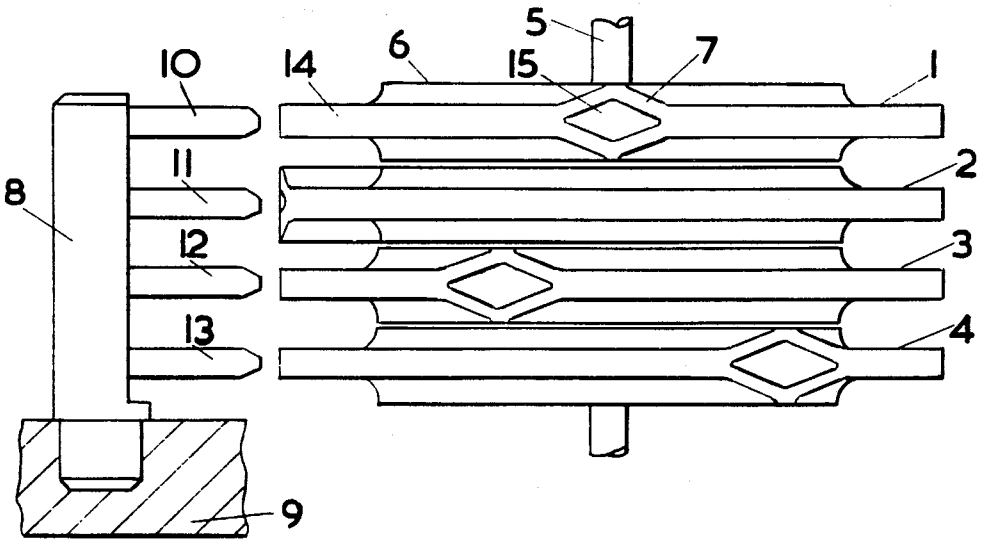
1
2
3
4
7
5
15
6
14
10
11
12
13
9
8

ANTI-MANIPULATION DEVICE FOR PERMUTATION LOCKS

This invention relates to permutation locks for safes and the like, having a dial which is rotatable firstly to actuate tumblers or permutation discs to set the permutation, and secondly to actuate the bolt of the lock. A well known method of manipulating a permutation lock is to determine, by the use of X-rays or other penetrating electromagnetic radiation, the position around the permutation discs of the recesses into which the fence of the lock can engage when the discs are in the open position. It is an object of the present invention to modify the construction of a permutation lock in such a manner as to hinder such manipulation of the lock mechanism which might enable the permutation setting to be determined, and thus enable the bolt to be retracted.

According to the present invention there is provided a permutation lock having a wheel pack comprising a plurality of rotatable permutation discs each of which includes a recess, a bolt, and a fence which moves with the bolt and which engages in the recesses when the bolt is in a retracted position, characterised in that the opacity of the wheel pack to penetrating electromagnetic radiation along any line parallel to the axis of rotation of the discs is independent of the circumferential position of any recess.

Thus, permutation locks of this invention can comprise a bolt, a fence member mounted on or formed integrally therewith, a wheel pack comprising permutation discs (otherwise called tumblers) rotatably mounted on a shaft, each of the permutation discs being provided with a recess in its periphery, into which recess the fence member engages when the bolt is retracted, a dial rotatably mounted on the shaft for rotating the permutation discs and actuating the lock, the arrangement being such that the opacity to penetrating electromagnetic radiation of the wheel pack in any line parallel to the shaft does not depend on the circumferential position of any recess.

Where the thickness of the material of the permutation discs through their recesses is less than elsewhere, the permutation lock of the invention may comprise discs, each of which carries a projection and is mounted on the shaft adjacent a permutation disc. The discs are of smaller diameter than the permutation discs and are each provided with a radial projection aligned with, and having the same dimensions as, the recess.

In a preferred embodiment, each permutation disc is in the form of a disc having a recess extending radially inwardly from its periphery, formed within the disc as if by division of the material of the disc and displacement of it in directions parallel to the axis of rotation of the discs, the fence being engageable in the recesses when the wheel pack is in the position allowing opening of the bolt. In this preferred embodiment of the invention, the variation with circumferential position of the opacity to electromagnetic radiation of each permutation disc can be reduced substantially to zero for a beam passing through the wheel pack in a direction parallel to the axis of the rotation of the permutation discs. Preferably the recesses have a substantially constant rhombic cross section.

By way of example, one embodiment of the locking mechanism of a permutation lock in accordance with the invention will now be described with reference to the accompanying drawing which is a schematic elevation of the fence and the wheel pack of the lock.

In the drawing, a wheel pack forming part of a conventional lock operating mechamism and consisting of four identical tumblers 1, 2, 3 and 4, is rotatably mounted about a shaft 5 and can be rotated about the shaft 5 by rotation of a dial (not shown) also mounted on the shaft.

Each tumbler consists of a circular disc having a thick central portion 6 and a thinner peripheral portion 14, the material of one segment of the peripheral portion 14 being displaced in directions parallel to the rotational axis of the tumbler to form the surround 7 of a recess 15 having a substantially rhombic cross section. Conveniently the combined axial thickness of the recess 15 and its surround 7 is the same as the thickness of the central portion 6 of the tumbler.

Associated with the wheel pack is a fence comprising a post carrying a number of lugs and mounted on the bolt 9 of the lock and extending in a direction generally parallel to the shaft 5, the bolt being slideable in a radial direction with respect to the shaft so that the fence is movable in a fixed plane containing the shaft 5.

Four lugs 10, 11, 12 and 13 each of rhombic cross section are mounted on the post 8 at positions axially corresponding with the recesses 15 on the wheel pack, and extend towards the shaft 5 at right angles thereto, so that when the bolt 9 is withdrawn the lugs can enter and engage in the appropriate recesses if the permutation of the lock is correctly set.

It will be clear from inspection of the drawing that the thickness of the material of the surround 7 along any line passing through it on both sides of the recess is, within the limits of X-ray measurement, substantially equal to the thickness of the peripheral portion 14 of the tumbler along a parallel line, and therefore the orientation of the recess would be very difficult to assess using X-ray equipment.

It will be clear to those skilled in the art that the invention embraces many constructions of locking assembly, other than those described; thus the recesses may have a cross-section other than rhombic, and the number of tumblers may be other than four in number. Furthermore a security device constructed in accordance with this invention may be incorporated into many different forms of combination lock, provided that the lock includes elements corresponding to the bolt, fence and wheel pack as described.

We claim:

1. A permutation lock having a wheel pack comprising a plurality of rotatable permutation discs each of which has a peripheral portion and a radially extending recess in the peripheral portion thereof, a bolt, and a fence which moves with the bolt and which engages in the recesses of said discs when the bolt is in a retracted position, wherein the construction of the wheel pack is such that the total thickness, in a direction parallel to the axis of rotation of the permutation discs, of the material of each permutation disc is substantially constant along any cylindrical locus concentric with the said axis and passing through the recess.

2. A permutation lock as claimed in claim 1, wherein the recess in each permutation disc has a surround which protrudes from the plane of the permutation disc, said surround having a total wall thickness equal to the thickness of the permutation disc remote from the recess along any cylindrical locus concentric with the permutation disc and passing through the recess.

3. A permutation lock as claimed in claim 2, wherein each permutation disc has a relatively thick central portion, and a relatively thin peripheral portion which contains the recess, the surround of the recess protruding from the plane of the said peripheral portion such that the maximum total thickness of the recess and its surround is substantially equal to the thickness of the said central portion.

4. A permutation lock as claimed in claim 3, characterised in that each recess is of rhombic cross section.

* * * * *